US006223741B1

(12) United States Patent
Panos

(10) Patent No.: US 6,223,741 B1
(45) Date of Patent: May 1, 2001

(54) RESIDENTIAL-TYPE STOVE HOOD WITH FLUID FILTER CLEANING MEANS

(76) Inventor: Mihail Panos, 2019 W. Hill Ave., Fullertonb, CA (US) 92633

( * ) Notice: Subject to any disclaimer, the term of this patent is extended or adjusted under 35 U.S.C. 154(b) by 0 days.

(21) Appl. No.: 09/511,762

(22) Filed: Feb. 24, 2000

(51) Int. Cl.[7] ..... F24C 15/20

(52) U.S. Cl. ..... 126/299 E; 96/228; 55/DIG. 36; 454/55

(58) Field of Search ..... 126/299 E, 299 D, 126/299 R; 96/228, 229, 233, 242; 55/DIG. 36; 454/54, 55

(56) References Cited

U.S. PATENT DOCUMENTS

| | | | | |
|---|---|---|---|---|
| 4,231,769 | * | 11/1980 | Ahlrich | 126/299 E |
| 5,394,861 | * | 3/1995 | Stegmaier | 125/299 D |
| 5,472,342 | * | 12/1995 | Welsh, II et al. | 126/299 E |
| 5,662,097 | * | 9/1997 | Panos | 126/299 E |
| 5,755,214 | * | 5/1998 | Lai | 126/299 E |

FOREIGN PATENT DOCUMENTS 2 001 749 * 2/1979 (GB) .

* cited by examiner

*Primary Examiner*—Ira S. Lazarus
*Assistant Examiner*—Josiah C. Cocks
(74) *Attorney, Agent, or Firm*—William H. Pavitt, Jr.; David A. Belasco; Jacobs

(57) ABSTRACT

A stove hood, particularly useful for disposition over a stove abutting a kitchen wall, to capture smoke and other gasses arising from the stove heating elements. The hood includes a chamber, one side having a screened opening which is closeable, and a roof which extends from the top of the chamber over the stove heating elements. That portion of the roof defining the top of the chamber is provided with a vent which may be opened or closed, and communicates with a duct leading to a gas discharge area outside the residence. A spray head is disposed within the chamber and connected to a source of fluid under pressure. The floor of the chamber is provided with a drain. When the side opening of the chamber is closed by a plate-like member, the chamber and the screening over such opening, may be cleaned by turning on the fluid source to the spray head. Fluid falling to the bottom of the chamber passes out of the drain to a waste pipe or to a recycling unit. After such cleaning has been accomplished, the plate-like element may be removed from the screened opening.

7 Claims, 3 Drawing Sheets

RESIDENTIAL-TYPE STOVE HOOD WITH FLUID FILTER CLEANING MEANS

FIELD OF THE INVENTION

This invention relates generally to the field of stove hoods, but particularly to a hood arrangement for residential use whereby smoke, fumes and other gasses emanating from stove cooking are drawn into a chamber for passing up through a vent in communication with the outdoor atmosphere.

DESCRIPTION OF THE PRIOR ART

This invention represents a modification and improvement of the invention of my prior U.S. Pat. No. 5,662,097 granted Sep. 2, 1997. While the invention of that patent could be utilized in a residence wherein a cooking stove is disposed centrally in the kitchen, the invention of the prior patent is particularly directed for use in large commercial establishments, such as restaurants, cafeterias and other facilities which serve a large number of people. The invention of the prior patent is not particularly suitable for a residential kitchen where one side of the stove abuts a kitchen wall. This is because access is required to both sides of the stove in order to open and close both doors which are brought down against the screened openings at the time the hoods is being flushed out, as taught in the prior patent.

However, because of the effectiveness of the method of cleaning stove screens as taught in my prior patent, it has been found desirable to provide a modified form of hood which can be utilized with stoves disposed adjacent to at least one of the kitchen walls of a residential type structure.

SUMMARY OF THE INVENTION

The present invention comprises a hood having one side which may be secured to, or placed in abutment with, a kitchen wall with the opposite side of the hood normally being open to allow air, as well as fumes or smoke from the stove to be drawn through screening over such opening for removal through a duct projecting upwardly from the hood to be further passed via piping to the atmosphere outside of the residential structure. Such passage may be encouraged by providing a motor driven fan in or near the mouth of the duct with the latter being closeable by a flap or other type of valve. The open screened side of the hood may be provided with a removable plate-like member which, when inserted in the opening, serves to close it. This closure is effected when it is desired to clean the inside of the chamber and the screening over the opening. Such cleaning may be accomplished by a spray-type nozzle connected to a source of water or other fluid under pressure.

Thus, the screened opening serves to draw into the chamber and filter air with the gasses or fumes arising from the stove and accumulating under the roof portion of the hood. From the chamber the air and other gasses pass through the outlet duct to a location outside of the residence.

DESCRIPTION OF THE DRAWINGS

In the accompanying drawings.

DESCRIPTION OF THE PREFERRED EMBODIMENT

Figure 1:
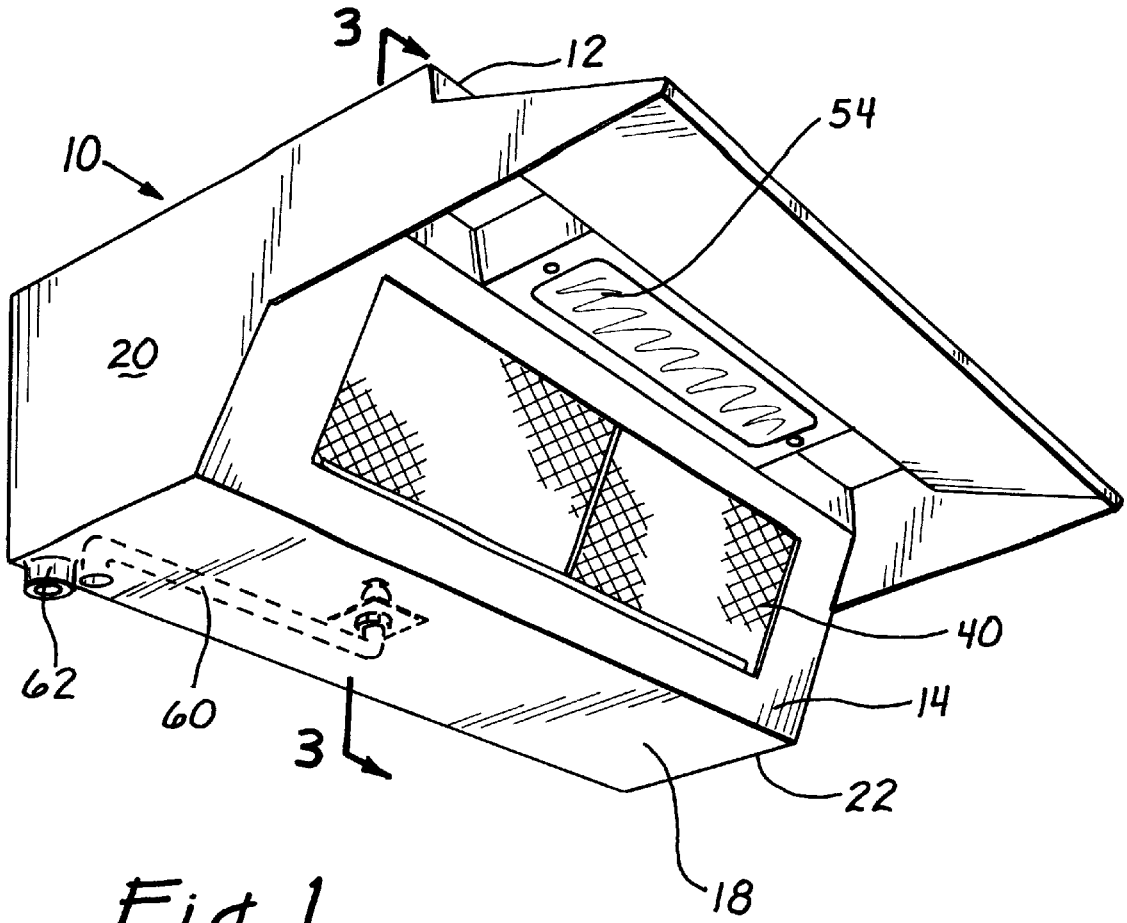
FIG. 1 is a perspective view of the preferred embodiment of the hood as seen from below its left side.
Figure 3:
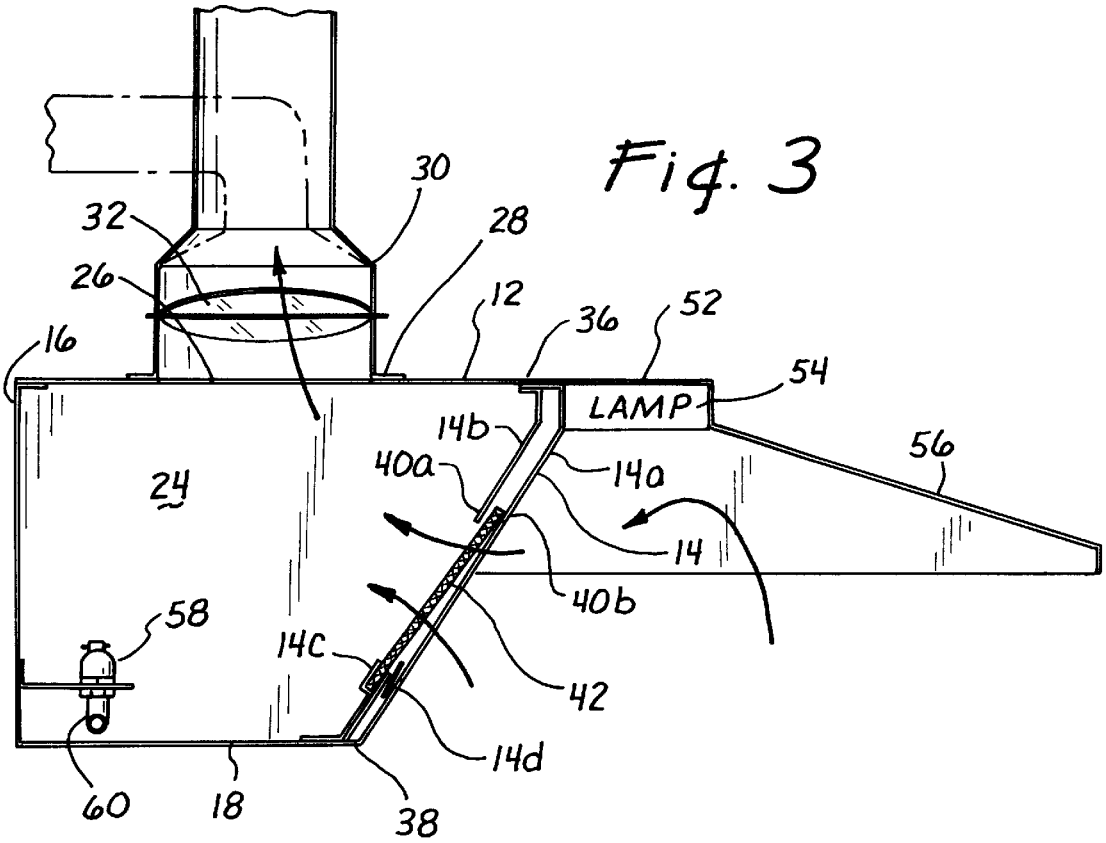
FIG. 3 is a section taken along the line 3—3 in FIG. 1.
Figure 4:
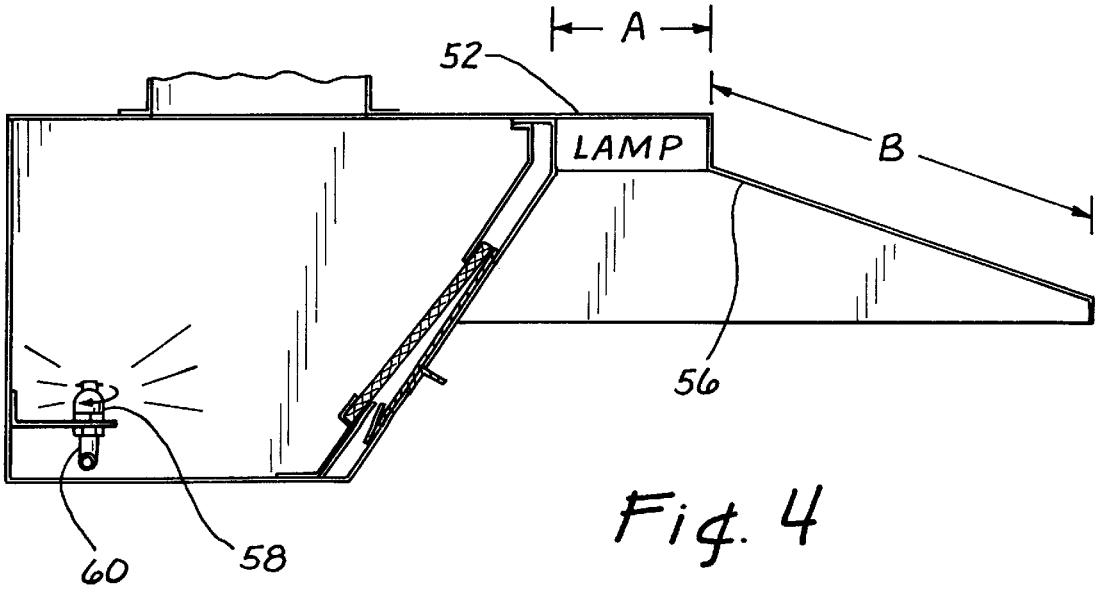
FIG. 4 is a section similar to FIG. 3, but showing the closure plate inserted to close the opening in the front wall.
Figure 6:
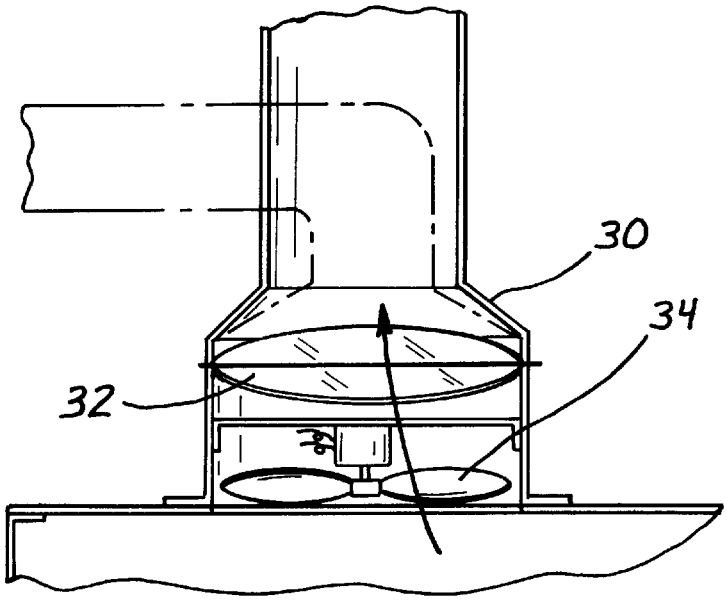
FIG. 6 is a partial section of the duct of FIG. 3 in which a motor driven impellor is provided.

Referring to FIGS. 1 and 3 of the drawings, the stove hood 10 may be formed of a roof 12, a front wall 14, a rear wall 16, a bottom wall 18, and a pair of side walls 20, 22. These walls are joined together to define the chamber 24. The roof 12 has an opening 26 which is covered by the lower end 28 of a duct 30 which leads to the outside of the residence (not shown) in which the hood is installed. A valve 32 may be provided to open or close the duct 30. Optionally, as shown in FIG. 6, a motor driven impeller 34 could be provided within the conduit 30 to increase the rate of flow of gasses from the chamber 24 up through the duct 30.

Figure 2:
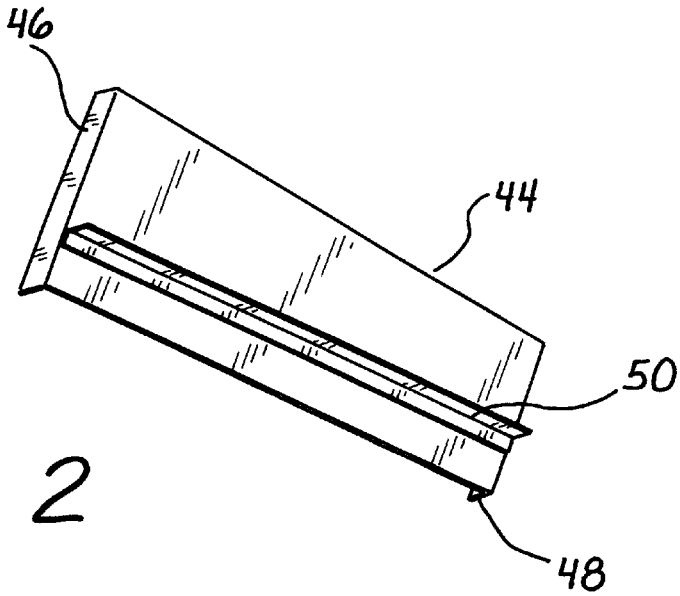
FIG. 2 is a similar perspective view of a closure plate.

The front wall 14 defining the chamber 24 is preferably angled down from the roof at a point 36 to the leading edge 38 of the bottom wall 18. A rectangular opening 40 is provided to extend for most of the width of the front wall 14. Desirably, the front wall 14 is actually fabricated of two spaced apart parallel sheets 14*a* and 14*b* which are separated from each other around the upper and lower edges 40*a*, 40*b* of the rectangular opening 40. Extending inwardly from the sheet 14*b* is an edge receiving channel 14*c* and a similar channel 14*d* extends inwardly from the outer sheet 14*a* toward the inner sheet 14*b*. A filter screen 42 is normally provided to seat in the channel 14*c* with its upper edge disposed between the open edges 40*a* and 40*b* of the sheets 14*b*, 14*a*, respectively. A closure plate as shown in FIG. 2, of a rectangular configuration and size may be provided to fit into and close the rectangular opening 40 in the front wall 14. This closure plate 44 desirably has ends right angled 46, 48 and a handle 50.

In the preferred embodiment of the invention, the roof 12 extends in its plane for a first predetermined distance A to accommodate the installation of a lamp 54, and then drops down to an angled section 56 of a second predetermined distance B to increase the area of coverage above the stove (not shown). These extensions of the roof 12 are preferably supported by extensions 20*a*, 22*a* of the side walls 20 and 22, respectively.

Within the chamber there is provided a high pressure spray device which is connected to a source of fluid (not shown) by piping 60. A drain 62 may be provided at one corner of the bottom wall 18.

In operation, the hood shown in FIGS. 1–4 of the drawings is particularly suited for use with a stove (not shown) which is located on one side of the kitchen with the back of the stove abutting one wall (not shown). Where a stove is so located, the hood of FIGS. 1–4 of the drawings would be installed above the stove or a range with its back wall 16 in abutment with the kitchen wall adjacent the rear of the stove or range.

When so installed, the roof extensions 52 and 56, together with the front wall 14 of the hood, will be disposed above the heating elements of the stove and, in such disposition then, will serve to capture any heated air or other gasses arising from the stove heating elements and to pass them through the screened opening in the front wall 14 of the hood 10. The heated gasses, which may be entrained with fluid particles, will be filtered by the screen 42 to precipitate out onto the screen such entrained particles. Following such filtration and passage into the chamber 24, the gasses will then enter the duct 30 through the opening 26 in the roof 12 of the hood 10 and from there, be passed on to an outlet (not shown) to the atmosphere. For this passage of the gasses through the duct to occur, the butterfly or other valve 32 would be set to its open position. On the other hand, when the stove is not in use, the valve 32 may be shut to prevent cold air, insects and/or dust from coming back down through the duct 30 into the chamber 24.

After a certain amount of use of the hood over the stove (not shown) it will be found that the screen 42 will become at least partially clogged by precipitated grease or other particles which have been entrained in the gasses passed through the screen 42. In order to cleanse the screen, as well as the insides of the roof 12, the front and back walls 14 and 16, the bottom wall 18 and the side walls 20 and 22, the plate 44 may be seated within the opening 40 in the front wall 14 to close the opening 40. The spray head 58 may be actuated to permit fluid under pressure arriving through the piping 60 to be sprayed against the walls defining the chamber 24 and the screen 42. If the fluid sprayed through the head 58 is not only warm, but contained a grease dissolving detergent, it will be found that the insides of the walls defining the chamber 24 and the screen 42 will be effectively cleansed. At the time of spraying, in order to avoid an accumulation of fluid in the lower portion of the chamber, the drain 62 may be opened to permit the accumulating fluid to pass down and out of the bottom of the chamber 24, either to a waste outlet or for recycling (not shown).

Following the cleaning of the walls defining the chamber 24, the plate 44 may be removed from the opening 40, so that the hood 10 may be further utilized in the manner previously described.

Figure 5:
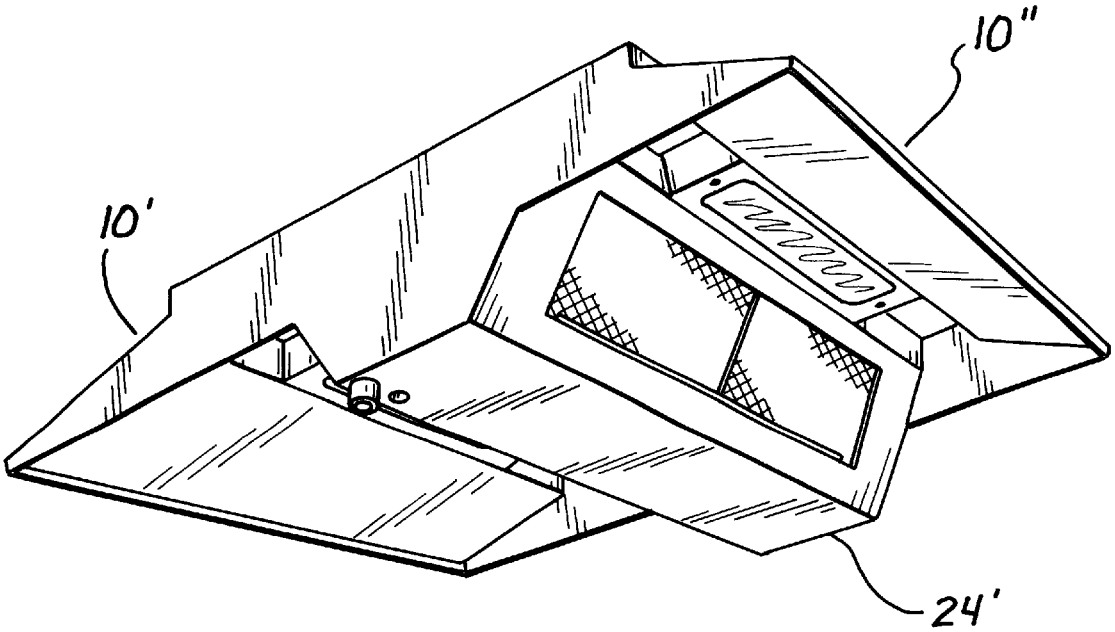
FIG. 5 is a perspective view taken similarly to FIG. 1, but of a dual face embodiment of the invention.

While the preferred embodiment of the invention is, as shown in FIGS. 1–4, and as described above, it would be possible to utilize the principles of this invention in a dual hood configuration illustrated in FIG. 5. This form of the invention would be applicable to a residential or other kitchen where the stove or range is not located in abutment with a side wall, but rather on an island spaced from the kitchen walls. In the embodiment of FIG. 5, the stove hood is symmetrically designed so that each hood 10', 10" is identical to what is illustrated in FIGS. 1–4 and has been described above, except that both sides of the dual hood 10', 10" may utilize a single chamber 24'.

I claim:

1. A self-cleaning hood for disposition above a heating emitting cooking stove, said stove being disposed against one wall of the kitchen, said hood comprising:

A housing including a vertical rear wall in abutment with said one wall of the kitchen, a front wall, a bottom wall having a drainage opening, a roof and a pair of oppositely facing end walls, each of said end walls being joined to one end of each of said rear wall, front wall, bottom wall and roof to define a closed chamber, and the bottom wall having a rear edge joined to the rear wall and a front edge joined to the front wall;

A roof,

Said roof being disposed in a first substantially horizontal plane and extended forwardly in the same plane over the forward wall for a first predetermined distance beyond a vertical plane including the front edge of the bottom wall, and then angled downwardly and forwardly for a second predetermined distance, said extended roof being supported by partial extensions of the side walls, Said chamber having an opening through the portion of the roof, said roof portion supporting an upwardly extending duct covering said opening, thereby to place the duct in communication with said chamber;

The front wall being angled upwardly and outwardly from the bottom wall to a joinder with the roof, inward of the roof extension, said angled front wall having a rectangular opening, the last said opening being covered by a removable porous screen and closeable from outside the chamber by a plate member, said plate member being removably receiveable in said opening to provide a substantially water tight fit when said plane member is disposed to cover said opening, said plate member having gripping means, whereby said member may be placed in said rectangular opening to close the same or to be removed from said opening;

A liquid spray head disposed within said chamber and connected to a source of fluid under pressure, and means to control the emission of fluid from said head, whereby, when fluid under pressure is emitted from said spray, such fluid serves to cleanse the inner walls of the chamber and the screen in the rectangular opening; and the fluid falling to the bottom of the chamber is passed through the drainage outlet for disposition as waste water or for recycling.

2. The hood as described in claim 1 wherein a lighting element is disposed under the roof in the area where it is extended for the first predetermined distance.

3. The hood as described in claim 1 wherein motor driven impeller means is disposed in the duct to draw gas accumulated in the chamber from the chamber and into the duct and further to impell the gas out through the duct for disposition elsewhere, such as the outside atmosphere.

4. The hood as described in claim 1 wherein valve means are disposed in the duct, said valve means being openable or closeable from outside the duct.

5. The hood as described in claim 1 wherein the roof is extended in the same plane over the forward wall for a first predetermined distance and then is angled at a downward slope for a second predetermined distance, said extension of the roof being supported by partial extensions of the side walls, whereby hot air and gasses arising from the stove may be captured and caused to enter the chamber through the screen covered rectangular opening in the front wall and then be evacuated from said chamber through the duct.

6. The hood as described in claim 1 wherein the back wall defining the chamber is placed in abutment with a wall in the kitchen with which wall the stove is also disposed in substantial abutment.

7. The hood as described in claim 5 wherein the roof is extended rearwardly in identical manner to its extension over the forward wall and the back wall of the hood is replaced by a wall configured oppositely but identically to the front wall, and supported by oppositely extending but identical supporting portions of the side walls, and a cover plate is provided to close the screen opening on said replacement to the back wall.

* * * * *